US008567829B2

(12) United States Patent
Suzuki

(10) Patent No.: US 8,567,829 B2
(45) **Date of Patent: *Oct. 29, 2013**

(54) SAFETY DEVICE, AND OPENING AND CLOSING MECHANISM

(71) Applicant: NIFCO Inc., Yokohama (JP)

(72) Inventor: Keisuke Suzuki, Utsonomiya (JP)

(73) Assignee: Nifco Inc., Yokahama-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/646,064

(22) Filed: Oct. 5, 2012

(65) Prior Publication Data

US 2013/0025206 A1 Jan. 31, 2013

Related U.S. Application Data

(62) Division of application No. 12/735,265, filed on Jul. 6, 2010, now Pat. No. 8,393,651.

(30) Foreign Application Priority Data

Dec. 26, 2007 (JP) ..... 2007-333611

(51) Int. Cl.
*E05B 63/20* (2006.01)
*E05C 19/00* (2006.01)

(52) U.S. Cl.
USPC ..... 292/150; 292/1; 292/332; 292/DIG. 4; 292/DIG. 22; 292/DIG. 65

(58) Field of Classification Search
USPC ..... 292/1, 150, 332–336, DIG. 4, DIG. 22, 292/DIG. 65
See application file for complete search history.

(56) References Cited

U.S. PATENT DOCUMENTS

| | | | | |
|---|---|---|---|---|
| 5,211,431 | A * | 5/1993 | Koizumi et al. | 292/81 |
| 5,217,262 | A * | 6/1993 | Kurosaki | 292/6 |
| 5,498,039 | A * | 3/1996 | Bivens | 292/145 |
| 6,808,214 | B2 * | 10/2004 | Sato et al. | 292/341.15 |
| 6,869,114 | B2 * | 3/2005 | Ueki | 292/341.17 |
| 7,017,956 | B2 * | 3/2006 | Kogami | 292/224 |
| 7,231,692 | B2 * | 6/2007 | Harada | 16/345 |
| 7,278,664 | B2 * | 10/2007 | Su et al. | 292/304 |
| 7,407,200 | B2 * | 8/2008 | Ichimaru | 292/194 |
| 7,766,407 | B2 * | 8/2010 | Nakaya | 296/24.34 |
| 7,959,202 | B2 * | 6/2011 | Ahn | 296/37.8 |
| 8,052,181 | B2 * | 11/2011 | Nishida | 292/332 |
| 2003/0071047 | A1 * | 4/2003 | Harada | 220/835 |
| 2004/0140675 | A1 * | 7/2004 | Kogami | 292/1 |
| 2006/0208506 | A1 * | 9/2006 | Kern et al. | 292/304 |
| 2009/0277906 | A1 * | 11/2009 | Ahn | 220/326 |
| 2010/0283267 | A1 * | 11/2010 | Suzuki | 292/150 |

* cited by examiner

*Primary Examiner* — Carlos Lugo
(74) *Attorney, Agent, or Firm* — Manabu Kanesaka

(57) ABSTRACT

A safety device used together with a push-push type latch device latching and releasing a movable body to a main body by a push operation against an urging force of an urging device, has a circulation cam groove having a reciprocation groove portion and a latch groove portion; a responding member having a pin to trace the circulation cam groove and a balancer disposed therein; and an urging member disposed on the responding member to urge the responding member in a pull-in direction. When the responding member receives a load, the responding member slides against an urging force of the urging member and the pin irreversibly moves from the reciprocation groove portion to the latch groove portion, so that even if the latching of the latch device is released due to the load, the movable body is retained in the fixed position.

5 Claims, 12 Drawing Sheets

SAFETY DEVICE, AND OPENING AND CLOSING MECHANISM

FIELD OF TECHNOLOGY

This invention relates to a safety device, which is used together with especially a push-push type (this can be also called as a push-lock and push-open type) latch device, among the latch devices which latch/release a movable body at a fixed position of a main body, and which can retain the movable body at a main body fixed position even if the latching of the latch device is released by a load (which is synonymous with an inertial force, hereinafter the same) such as an impact, and the like applied from the outside, and an opening and closing mechanism comprising the same.

BACKGROUND ART

The push-push type latch device latches the movable body such as a lid and the like to the main body at the fixed position (usually, a closed position) of the main body by a push operation against an urging force of an urging means, and by the next push operation, the above-mentioned latching is released. This latch device excels in usability in that both the latching and releasing can be carried out by the push operation to the movable body; however, in a latched state, if the movable body receives the inertial force accompanied by a sudden stop and the like, it happens that the latch device can be moved in a direction same as the push operation at the time of the release, so that there is a possibility of being released from the latching by an operation error. As a measure against this, there are two major types of the latch device: an inside installation type (for example, Japanese Patent No. 2912433) wherein a safety function is added to the latch device itself, and an exclusive type which is independent from the latch device exemplified in Japanese Patent Document 1 and the like. Incidentally, compared to the exclusive type, the inside installation type is easily limited in safety performance or accuracy by the relation of disposing structural members inside a latch case.

FIGS. 12(*a*), 12(*b*) show a safety device of Japanese Patent Document 1, FIG. 12(*a*) shows a state in which the inertial force is not applied, and FIG. 12(*b*) shows a state in which the inertial force is applied. This overall structure comprises a housing H whose left side is open; a movable body (storage box) B; urging means which is not shown in the figures and urges the movable body B in an open direction; and push-push type latch device which is not shown in the figures. By the above-mentioned latch device, the movable body B is latched to a blocked position of the housing H by the push operation against the urging force, and by the next push operation, the latching of the movable body B is released, so that the movable body B can move in the open direction of the housing H.

The safety device has a structure of being provided with a rotational body 1 pivotally supported at an axis member 3 in the housing H and urged in one direction through a spring 2; and an inertial responding-body 4 which can be varied between a standby position and an operation position. Also, a projection allowing the rotational body 1 to rotate in an opposite direction against the urging force of the spring 2 is provided when a blocked state of the movable body B itself is released. Only when the inertial force acts, the inertial responding body 4 is moved in the operation position, and the rotation in the opposite direction of the rotational body 1 is halted. In other words, in this structure, when the inertial force is applied, the movable body B is pushed in an arrow direction due to inertia in the same way that the inertial responding body 4 is projected against the urging of a coil spring 6 as in FIG. 12(*b*) due to the inertia. Even if the rotational body 1 is attempted to be rotated clockwise against an urging pressure of the spring 2, the rotational body 1 hits the inertial responding body 4, which is projected due to the inertia, so that the rotational body 1 cannot rotate. Thereby, the movable body B is halted so as not to move in the same direction to release the latching of the latch device through the projection 9 which is controlled by the above-mentioned rotational body 1.

Patent Document 1: Japanese Utility Model Publication No. H05-75003

DISCLOSURE OF THE INVENTION

Problems to be Solved by the Invention

In the above-mentioned conventional safety device, after the inertial responding body 4 is projected against the urging of the coil spring 6 as in FIG. 12(*b*), the inertial responding body 4 is returned to an original position again as in FIG. 12(*a*); however, the time when the inertial responding body 4 thereof stays in a projected position is extremely short. Consequently, the movable body B hits the rotational body 1, which is not controlled by the inertial responding body 4 through the projection 9 by the timing wherein the movable body B is pushed in the arrow direction in FIG. 12(*b*) due to the inertial force, so that it can also happen that the movable body B is moved in a direction releasing the latching of the latch device. Such operation error can easily take place in the case when the inertial force while fluctuating is repeatedly applied.

For the above-mentioned background, an applicant of the present invention previously developed Japanese Unexamined Patent Application No. 2007-308977 as a safety device in order to reliably control the operation error of the push-push type latch device. Objects of the present invention are to further improve the safety performance or accuracy of the safety device and promote usage expansion by enhancing the credibility of the push-push type latch device of a subject.

Means for Solving the Problems

In order to achieve the above-mentioned objects, this invention is used together with a push-push type latch device, which latches a movable body to a main body at a fixed position of the above-mentioned main body by a push operation against an urging force of an urging means and which allows the above-mentioned latching to be released by the next push operation. The invention comprises a circulation cam groove provided in either the above-mentioned main body or the above-mentioned movable body and including a reciprocation groove portion and a latch groove portion; and a responding member provided to the other of the above-mentioned main body or the above-mentioned movable body and including a pin tracing the above-mentioned circulation cam groove. When the above-mentioned responding member receives a load such as an impact and the like, the above-mentioned pin irreversibly moves from the above-mentioned reciprocation groove portion of the above-mentioned circulation cam groove to the above-mentioned latch groove portion, and even if the latching of the above-mentioned latch device is released due to the load such as the impact and the like, the above-mentioned movable body is retained in the above-mentioned fixed position. In the above present invention, "irreversibly moving to the latch groove portion" means that when the responding member receives the load (inertial force) such as the impact and the like, and the pin once moves to the latch groove portion from the reciprocation groove portion, even if the inertial force disappears (for example, unless the push operation relative to the movable body is not carried out as shown in an embodiment), the pin does not return to the reciprocation groove portion from the latch groove portion.

The above safety device completely differs from a point of view of a conventional device as a measure against an operation error caused by the inertial force of the push-push type latch device. In the conventional device, when the latch device in a latched state receives the inertial force in the same direction as the push operation for releasing the latching, the movement of related members is halted so as not to be switched from the above-mentioned latched state to a latch release. In contrast, the device of the present invention allows the latch device to be switched to the latch release from the latched state due to the inertial force, and even if the latching is released, the retaining in the same fashion as that of the latched state of the latch device, i.e., the state, wherein the movable body is retained in the fixed position of the main body, can be obtained without deteriorating the push operation of the latch device.

Next, a device structure and operation characteristics of the present invention will be clarified with reference to principle drawings (the same symbols are assigned to the functionally same members shown in FIGS. 2 to 11) of FIGS. 1(*a*) to 1(*d*). In FIGS. 1(*a*)-1(*d*), the reference numeral 1 represents the main body, and the reference numeral 2 represents the movable body. The reference numeral 3 represents the push-push type latch device, and the reference numeral 4 represents the safety device of the present invention. The latch device 3 is the most simplified structural example, and comprises a heart-shaped cam groove 30 provided on a movable body 2 side, and a pin 35 provided on a main body 1 side and tracing the cam groove 30. The safety device 4 comprises a circulation cam groove 40 provided on the movable body 2 side, and a responding member 41 provided on the main body 1 side and including a pin 45 tracing the circulation cam groove 40. Incidentally, the circulation cam groove 40 differs from the heart-shaped cam groove 30 in that the circulation cam groove 40 includes the reciprocation groove portion and the like. Also, as for the latch device 3, the cam groove 30 can be provided on the main body 1 side, and also the pin 35 can be provided on the movable body 2 side. As for the safety device 4, the circulation cam groove 40 can be provided on the main body 1 side, and also the responding member 41 including the pin 45 can be provided on the movable body 2 side. This respect is the same as that of both the embodiment and a modified example.

FIG. 1(*b*) shows an operation at a normal time when the latch device 3 and the safety device 4 have not received the inertial force. Specifically, the latch device 3 latches the movable body 2 to the main body 1 at the fixed position of the main body 1 by the push operation against an urging force, i.e., the pin 35 traces in arrow directions of a, b, c relative to the cam groove 30 so as to be latched to the latch groove portion of c. By the next push operation, the above-mentioned latching is released, i.e., the pin 35 traces in the arrow directions of c, d, eventually passes through e, and moves away from the cam groove 30. Thereby, the movable body is switched to the outside of the fixed position of the main body due to the urging force. In each process, when the pin 35 on the above-mentioned latch device side traces a, b, c of the cam groove 30 and c, d, and the like, the pin 45 only freely traces the reciprocation groove portion of f of the circulation cam groove 40, so that the safety device 4 never functions as a latch operation.

FIG. 1(*c*) shows an operation at an abnormal time when the movable body 2 receives the inertial force in the state wherein the movable body 2 is latched at the fixed position of the main body through the latch device 3. Specifically, in the latch device 3, the inertial force acts as in the next push operation, and the pin 35 escapes from the latch groove portion of c, and moves in a release direction of d. However, a further movement from e is controlled by the safety device 4. Specifically, when the safety device 4 receives the inertial force as in the above-mentioned fashion, the pin 45 irreversibly moves from the reciprocation groove portion of f (through a guide groove portion of g) to the latch groove portion of h, and as a result, the movable body 2 is retained at the fixed position of the main body.

FIG. 1(*d*) shows the operation when the movable body is pushed from the state of FIG. 1(*c*). By this push operation, in the safety device 4, the pin 45 traces from the latch groove portion of h to j, k of the release direction, and further moves away from the circulation cam groove 40. At the same time, in the latch device 3, in a latch release state, for example, after the pin 35 is once moved from e to d, the pin 35 traces to d, e, f which are the release direction, and further moves away from a circulation cam groove portion 30.

The above invention is preferred to be embodied as follows.

(A) The above-mentioned responding member has a structure of turning against an urging force of an urging member when the load such as the impact and the like is received, and of allowing the above-mentioned pin to move from the reciprocation groove portion of the above-mentioned circulation cam groove to the latch groove portion (preferred embodiment 1).

(B) The above-mentioned responding member has a structure of sliding against the urging force of the urging member when the load such as the impact and the like is received, and of allowing the above-mentioned pin to move from the reciprocation groove portion of the above-mentioned circulation cam groove to the latch groove portion (preferred embodiment 2).

(C) The above-mentioned responding member has a structure of being supported so as to be freely turnable through an axis member of the above-mentioned main body, of providing the above-mentioned pin in one side sandwiching the above-mentioned axis member, and of including a balancer on the other side (preferred embodiment 3).

(D) The above-mentioned responding member has a structure of being supported to the above-mentioned main body so as to be freely slidable through a retaining portion, and also of disposing the above-mentioned pin in a projecting end side which projects from the above-mentioned retaining portion (preferred embodiment 4).

(E) The above-mentioned circulation cam groove has a structure of allowing the above-mentioned pin to move from the above-mentioned reciprocation groove portion to the above-mentioned latch groove portion through a latching guide groove portion, and also of allowing the above-mentioned pin to move from the above-mentioned latch groove portion to the above-mentioned reciprocation groove portion again through a returning guide groove portion and the like by the push operation relative to the above-mentioned movable body (preferred embodiment 5).

Also, this invention is apprehended as an opening and closing mechanism of the movable body. In the opening and closing mechanism, which switches the movable body such as a door and the like from the open position to the closed position relative to the main body by the push operation against the urging force, and which also switches the movable body in an open direction from the closed position due to the urging force, the safety device is according to the above-mentioned.

Effect of the Invention

In this invention, if the inertial force is applied, the responding member detects the inertial force, and the pin provided in the responding member irreversibly moves from the reciprocation groove portion of the circulation cam groove to the latch groove portion so as to retain the movable body at the fixed position of the main body. As for characteristics of this safety device, because of an exclusive type, provided that the latch device is a push-push type, an existing article can be used as it is. Also, since structural members comprise the circulation cam groove, the responding member and the pin, it is simplified, and also even if the latching of the latch device is released, the movable body is reliably retained at the fixed position of the main body, thus, as the measure against the operation error of the latch device caused by the inertial force, this safety device can be the best.

Preferred embodiment 1 and 2 specify that, for example, the responding member can be practicable even with a turning type or a sliding type, thus, as a safety device, this excels in versatility as well.

In the preferred embodiment 3, since the responding member is pivotally supported relative to the main body through the axis member, and one side of the axis member includes the pin and the other side includes the balancer, a detecting ability of the responding member regarding the inertial force can be improved or stabilized. On the other hand, in the preferred embodiment 4, since the responding member is supported relative to the main body through the retaining portion, the detecting ability of the responding member regarding the inertial force can be stabilized.

In the preferred embodiment 5, the pin moves from the reciprocation groove portion to the latch groove portion due to the inertial force so that the movable body is retained at the fixed position of the main body and from that state, the pin is returned to the original reciprocation groove portion through the guide groove portion from the latch groove portion by the push operation. Accordingly, the preferred embodiment 5 can be reliably used repeatedly with a simple structure as the safety device. On the other hand, in this invention, the opening and closing mechanism fulfilling advantages of the above safety device is provided, and thereby, the credibility of the opening and closing mechanism can be improved.

BEST MODES OF CARRYING OUT THE INVENTION

Figure 1A:
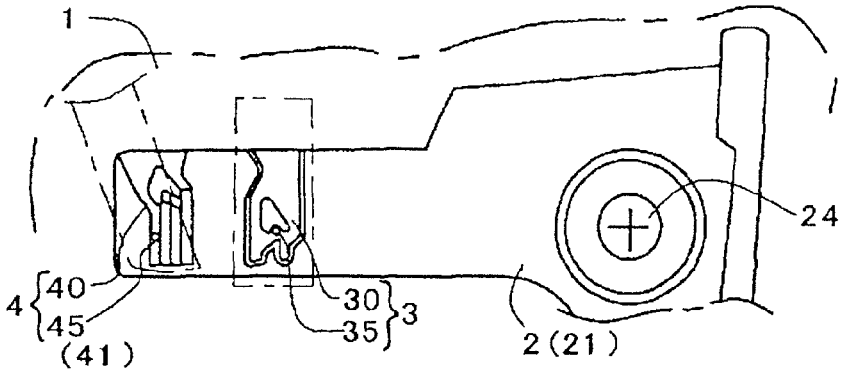
FIGS. 1(*a*), 1(*b*), 1(*c*), 1(*d*) are principle drawings showing principles of the present invention.
Figure 1B:
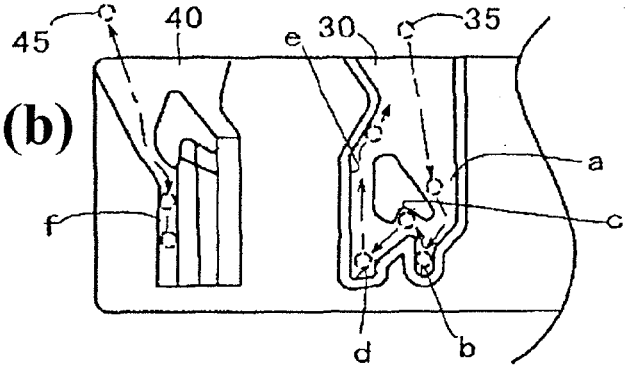
Figure 1C:
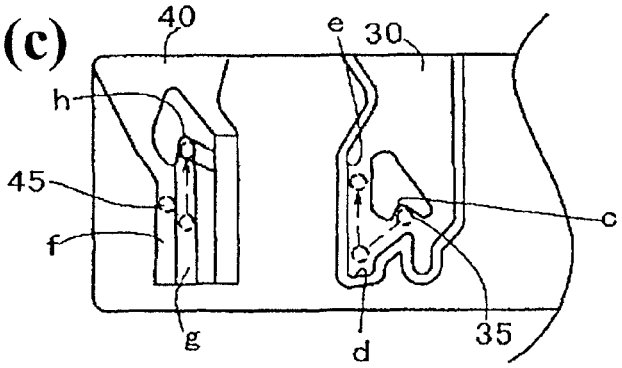
Figure 1D:
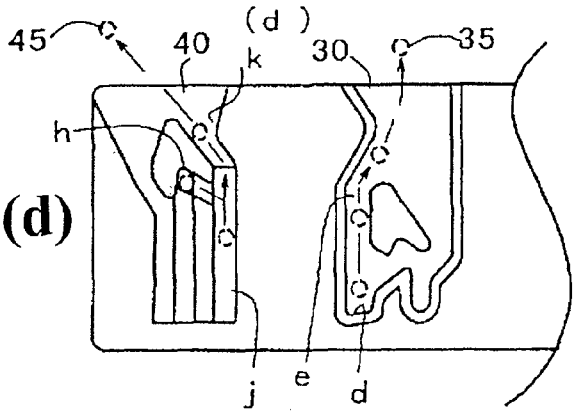
Figure 2:
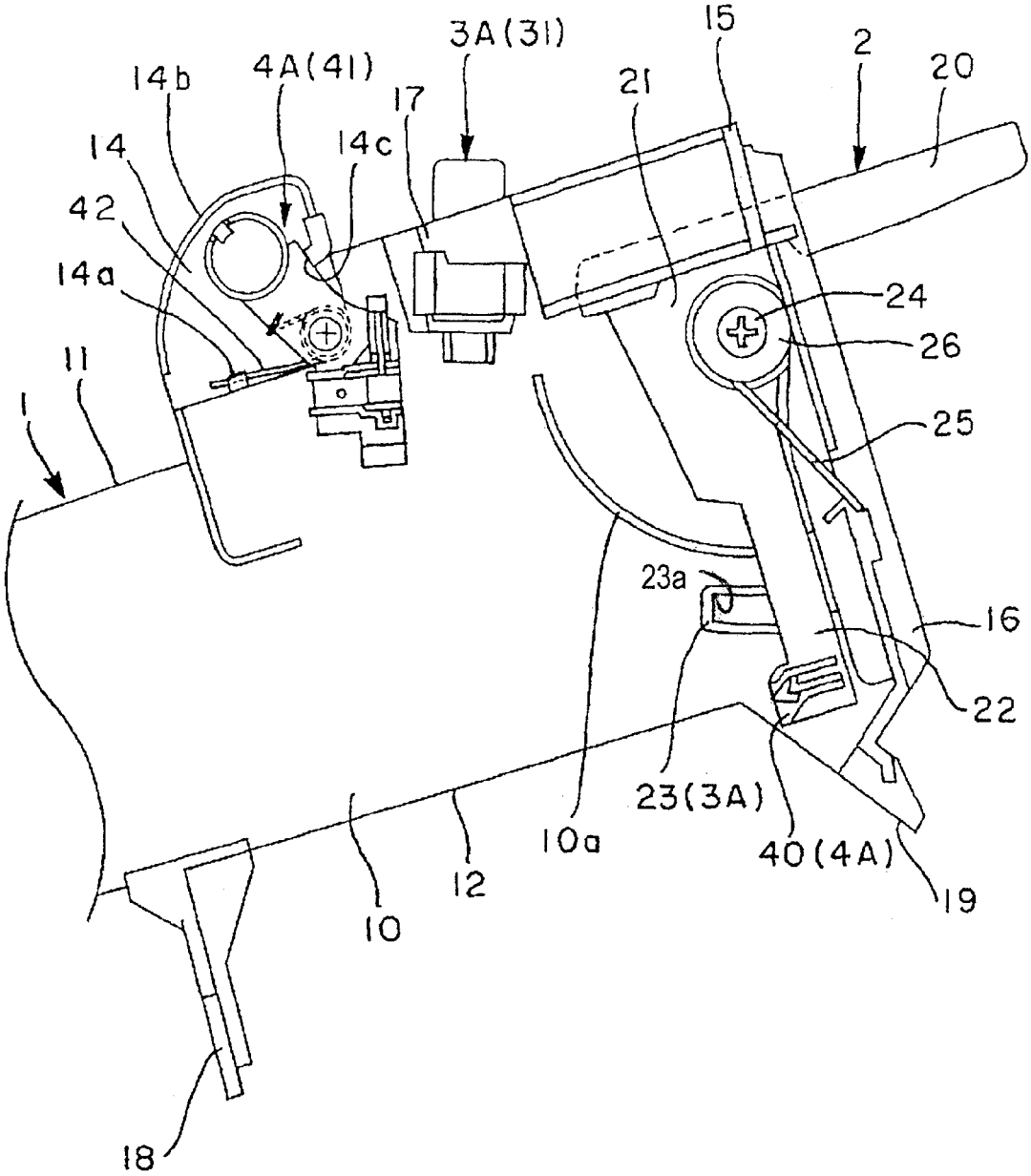
FIG. 2 is a side view showing an opening and closing mechanism in FIGS. 1(*a*) to 1(*d*) in a lid open position.
Figure 3:
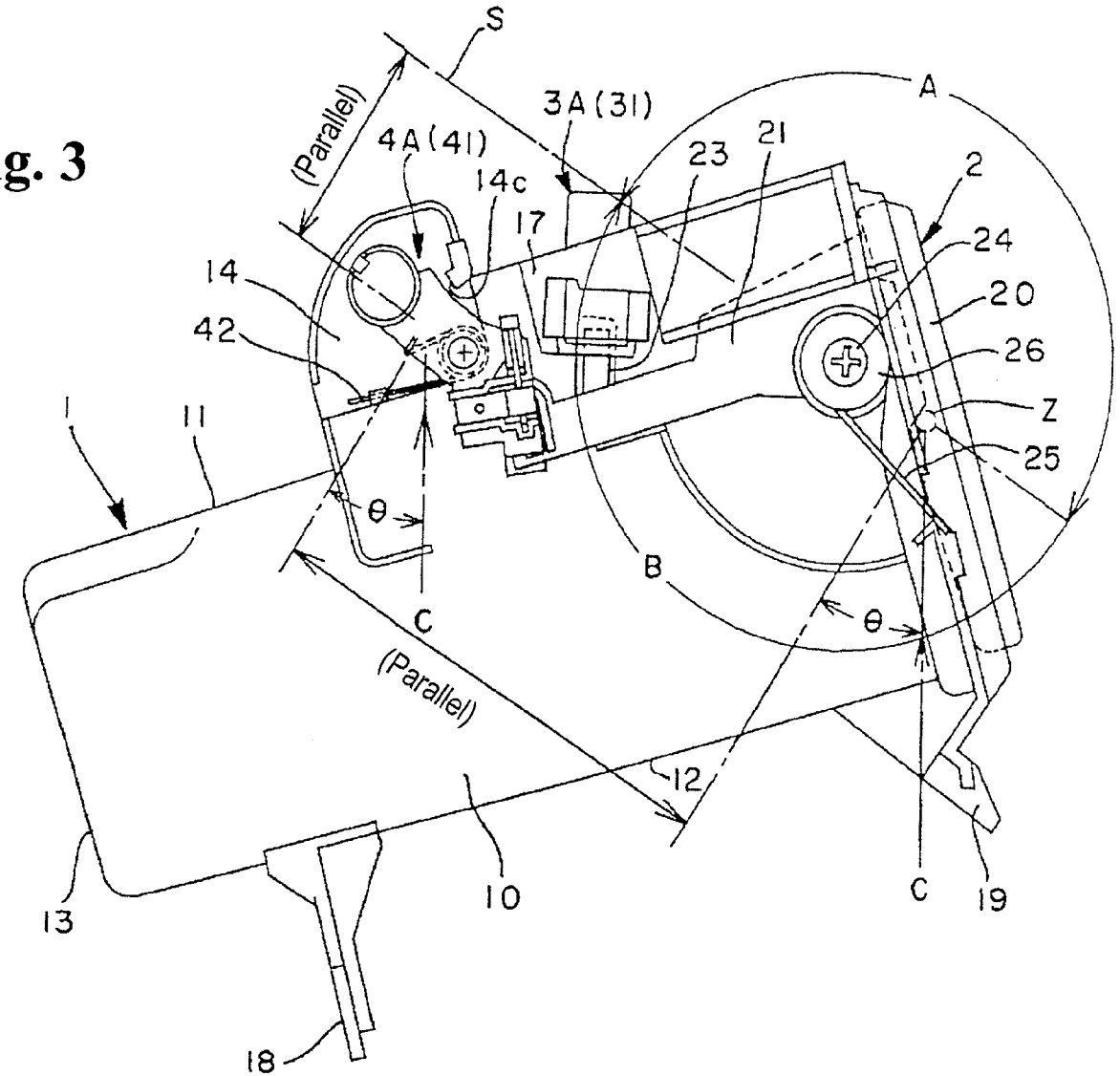
FIG. 3 is a side view showing the opening and closing mechanism in FIGS. 1(*a*) to 1(*d*) in a lid closed position.
Figure 8A:
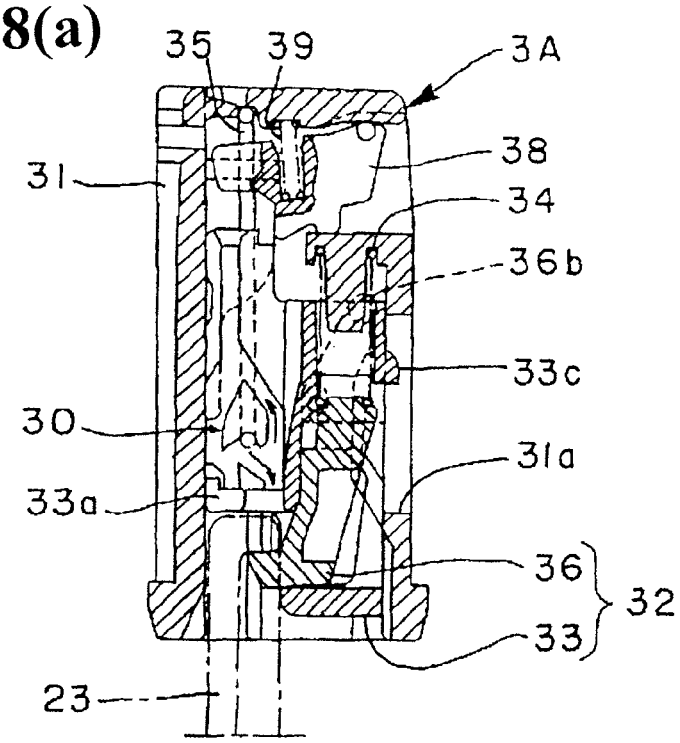
FIG. 8(*a*) shows a latched state of the above-mentioned latch device, and FIGS. 8(*b*), 8(*c*) show an operation at an abnormal time (when an inertial force is received) of the safety device, and an operation when the safety device is returned to a state of the normal time.
Figure 8B:
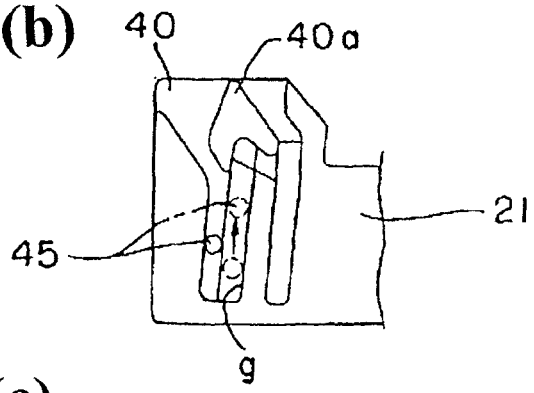
Figure 8C:
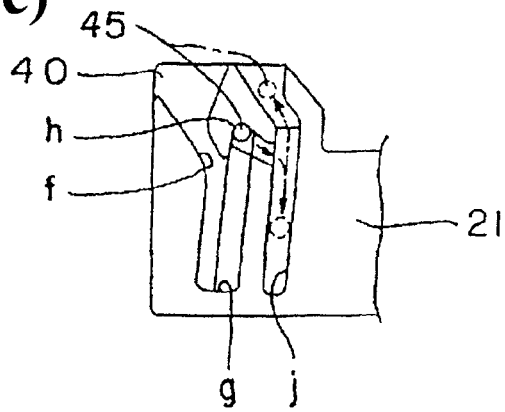
Figure 9A:
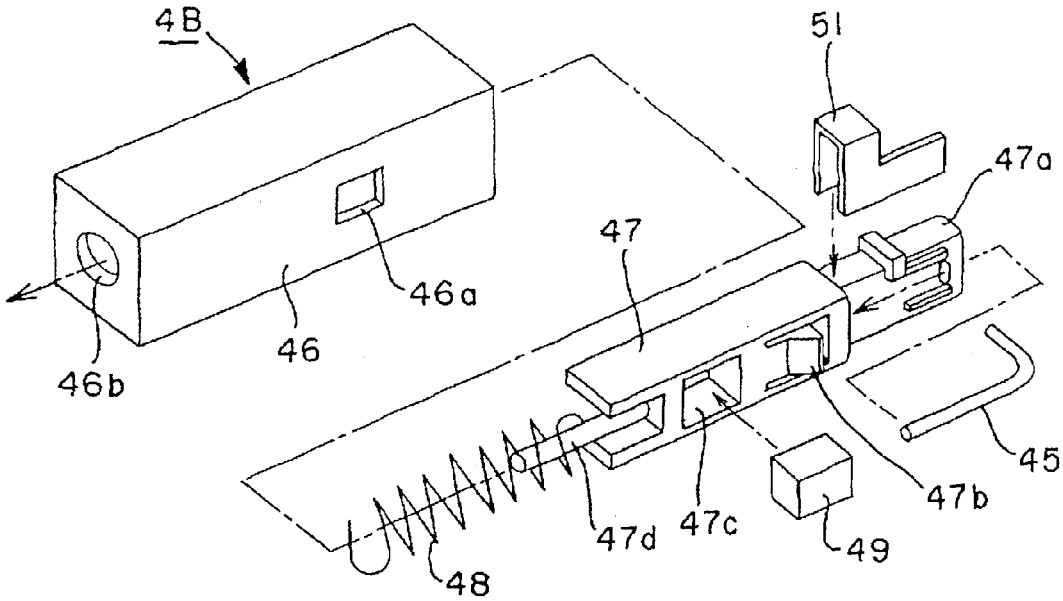
FIGS. 9(*a*), 9(*b*), 9(*c*) show a modified example of the above-mentioned safety device, wherein FIG. 9(*a*) is an exploded perspective view, FIG. 9(*b*) is a drawing viewed from the top, and FIG. 9(*c*) shows a main body in a cross-sectional state.
Figure 9B:
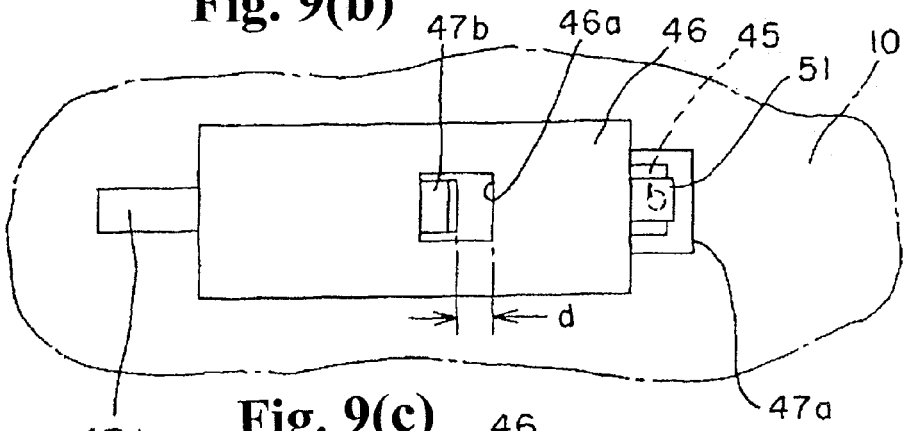
Figure 9C:
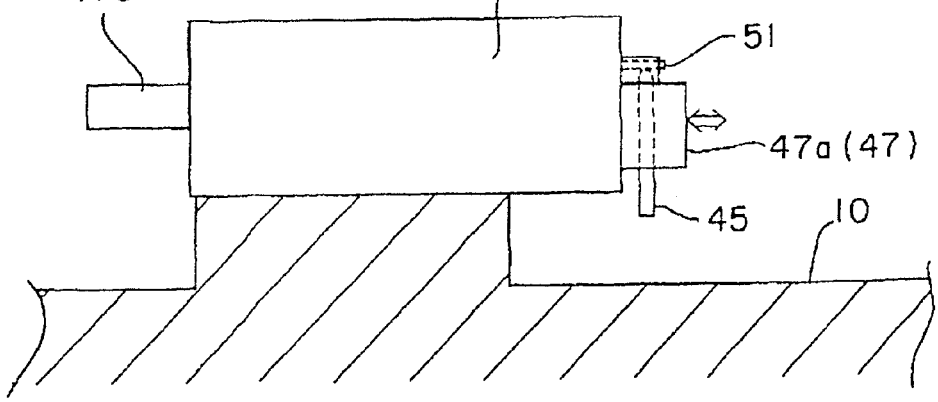
Figure 10:
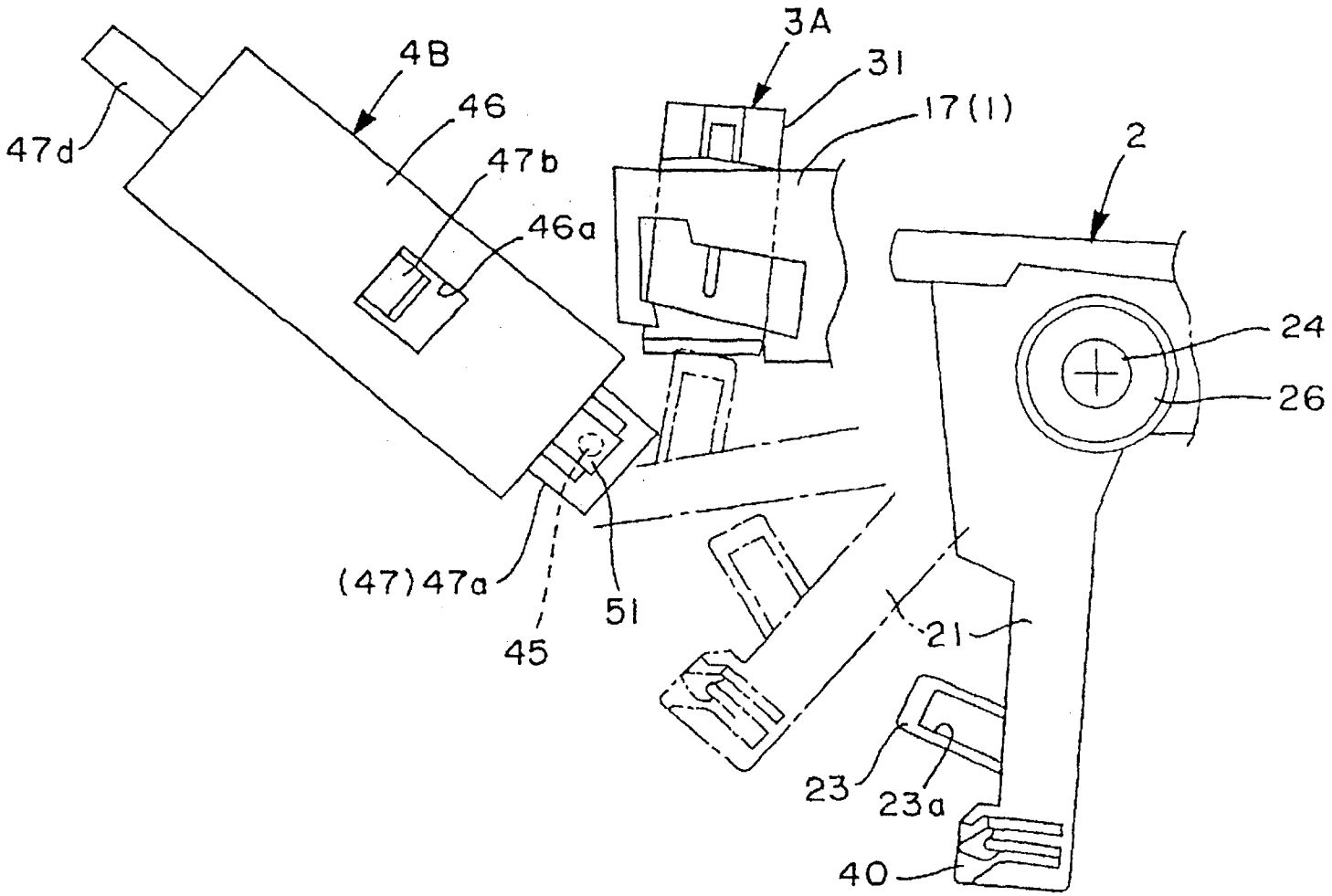
FIG. 10 is a structural view showing the lid open position corresponding to FIG. 5.
Figure 11:
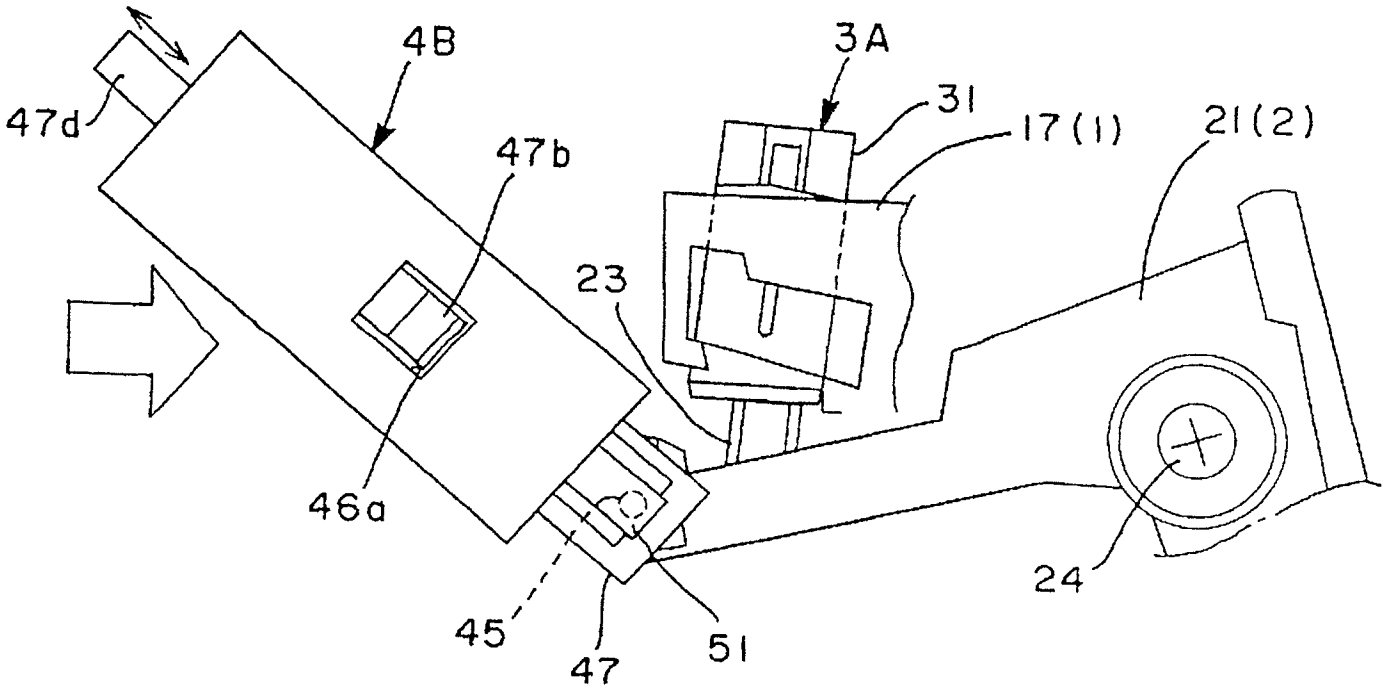
FIG. 11 is a side view showing the lid closed position corresponding to FIG. 6.

Hereinafter, best modes of the present invention will be explained with reference to attached figures. FIGS. 1(*a*) to 1(*d*) show principles of the present invention, FIGS. 2, 3 show an overall structure, FIGS. 4(*a*) to 4(*c*) show a safety device, and FIGS. 5 to 8(*c*) show operations. FIGS. 9(*a*) to 9(*c*) show a modified example of the above-mentioned safety device, FIGS. 10, 11 show operations in the case that the safety device in FIGS. 9(*a*) to 9(*c*) is used. In the following explanation, an opening and closing mechanism, a latch device, the safety device, the operations, and the modified example of the safety device will be explained in detail in this order. Incidentally, in FIGS. 2, 3, some parts are omitted or simplified for reasons of a drawing construction.

(Opening and closing mechanism) As shown in FIGS. 2, 3, the opening and closing mechanism of an embodiment has a structure of switching a lid 2 by turning between an open position shown in FIG. 2 wherein a housing side opening portion is opened, and a closed position shown in FIG. 3 which blocks the opening portion, relative to a housing 1. The opening and closing mechanism comprises a spring member 25 urging the lid 2 in an open direction; a damper which is not shown in the figures and brakes an opening and closing speed of the lid 2; a push-push type latch device 3 which latches the lid 2 against an urging force of the spring member 25 or releases the latching; and a safety device 4 of essential parts.

Here, the housing 1 is a main body of a storage device for vehicles such as an automobile and the like, and opens a near side (a right side in the figures, and hereinafter, called a back side) by being defined by both side faces 10, an upper face 11, a bottom face 12, and a back face 13. Both side faces include a placement portion 14 for the safety device which projects approximately from the middle of the front and back on the upper side; an upper attachment portion 15 which projects from an upper near side; a bordering portion 16 which extends downwardly from the back end of the upper attachment portion 15; a placement portion 17 for the latch device which is provided in a front end face of the upper attachment portion 15; and a window portion which is not shown in the figures, is provided between the upper attachment portion 15 and the bordering portion 16, and corresponds to supporting arm portions 21 of the lid 2, and the like. The placement portion 14 includes a spring latch portion 14*a* which is an approximately vertical flat surface supporting a safety device 4A (4B) and projects from the flat surface; a protecting guard portion 14*b* rising up in a border portion of the flat surface; and a control portion 14*c* projecting from a back lower end side of the guard portion 14*b*. The placement portion 17 is formed in a frame shape penetrating up and down, and supports a latch device 3A downwardly relative to the frame shape portion. The reference numeral 10*a* represents a guiding circular rib around a lid attachment portion, and the reference numerals 18, 19 are attachment portions downwardly provided in the front and back on the bottom face 12.

The lid 2 has an approximately short plate shape corresponding to the housing side opening portion, and includes the right-and-left arm portions 21 projecting from both sides of an inner wall, and a bumping portion 23 and a circulation cam groove 40 provided in a fore-end portion 22 of the arm portion 21 on one side. The bumping portion 23 includes a concave portion 23*a* which is latched to/released from the after-mentioned latch device 3A, and the circulation cam groove 40 constitutes a safety device 2. In the above-mentioned lid 2, each arm portion 21 is disposed outward from the above-mentioned window portion relative to the side faces 10 of the housing 1, and is pivotally supported to be capable of turning through a collar 26 and a screw 24 and the like. Also, in the spring member 25, one end is latched to a bordering portion 16 side in a state wherein the spring member 25 is wound around the collar 26, and the other end is latched to a corresponding portion (not shown in the figures) of the arm portion 21 so as to always urge the lid 2 in an opening direction.

Figure 7A:
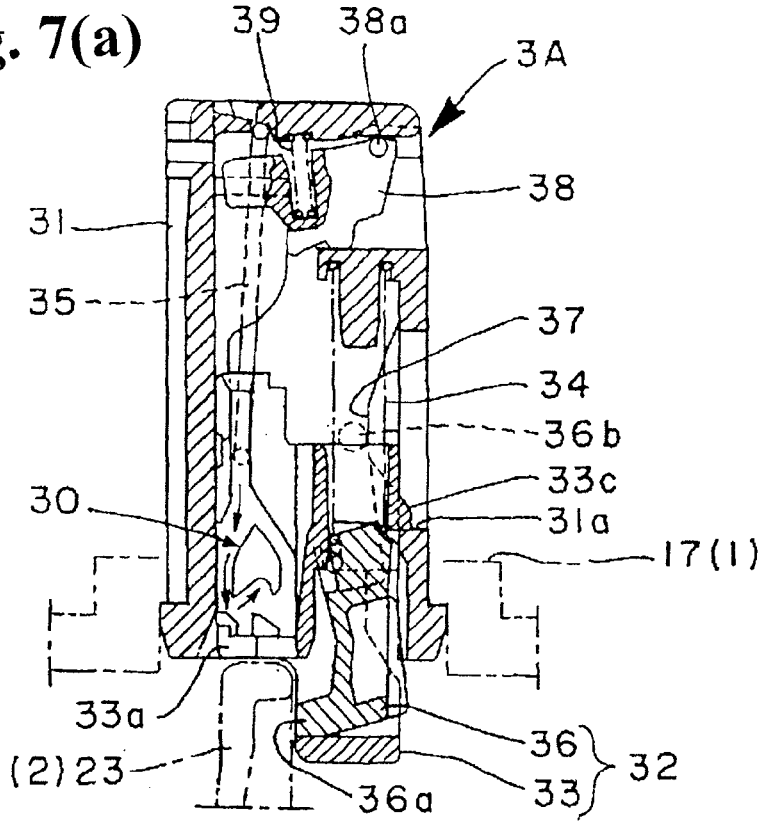
FIG. 7(*a*) shows a latch release state of the above-mentioned latch device, FIG. 7(*b*) shows an operation example at a normal time of the safety device, and FIG. 7(*c*) is a sectional view taken along line A-A in FIG. 7(*b*).
Figure 7B:
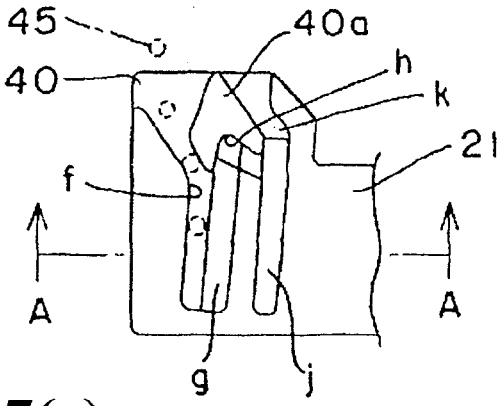
Figure 7C:
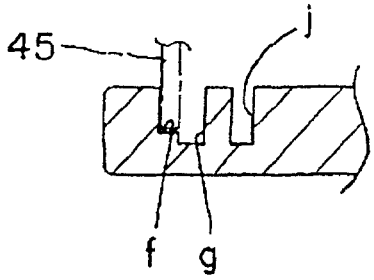

(Latch device) As shown in FIGS. 7(*a*), 8(*a*), this latch device 3A comprises a case 31 whose lower end is open; a sliding body 33 which includes a receiving portion 33*a* abutting against the bumping portion 23 on a lid side and a cam groove 30, and is disposed inside the case 31 and moved against an urging force of a spring member 34; a pin 35 tracing along the cam groove 30; and an engagement body 36 which includes a fore-end side claw 36*a* and a projection 36*b* on a base end side and is pivotally supported by the sliding body 33. Among these, the sliding body 33 and the engagement body 36 constitute a latch member 32 which directly acts to the bumping portion 23. The engagement body 36 is pivotally supported in the state wherein an axial portion on the lower side than the middle of the top and the bottom is fitted into the sliding body 33. Due to the movement (this movement is controlled by a sliding body side projection 33*c* and a long groove 31*a* on a case 31 side where the projection 33*c* is slidably fitted) of the sliding body 33, the engagement body 36 is switched between a latch release position wherein the engagement body 36 is almost housed inside the sliding body 33 as shown in FIGS. 7(*a*) to 7(*c*), and a latch position wherein the engagement body 36 holds the bumping portion 23 on the lid side by projecting the claw 36*a* from the inside of the sliding body 33 as shown in FIGS. 8(*a*) to 8(*c*). In the latch release position, the sliding body 33 is moved to an entrance side of the case 31 by the urging force of the spring member 34, and the engagement body 36 allows the projection 36*b* to run on a rib 37 provided inside the case 31, so that the state thereof is maintained. In the latch position, the sliding body 33 is moved to a rear side against the urging force of the spring member 34 by a pushing force of the bumping portion 23, and maintained in the position after the movement through the engagement between the cam groove 30 and the pin 35. The engagement body 36 moves the projection 36*b* to a portion where the rib 37 is lowered, and also tilts, so that the claw 36*a* is projected from the inside of the sliding body 33.

In the above latched state, if the lid 2 receives an inertial force in a closing direction due to an impact accident, a sudden stop, and the like, the bumping portion 23 pushes the sliding body side receiving portion 33*a*. As a result, the pin 35 is moved in an arrow direction in FIGS. 8(*a*) to 8(*c*), so that due to an operation error, the latching may be released as well. The safety device 4A is for retaining the lid 2 in the closed position when the latching is supposedly released due to such operation error. Incidentally, this latch device comprises a safety function of an inside installation type which is called a G sensor comprising a responding body 38 provided on a case rear side and an urging member 39. When the latch device receives the inertial force, the responding body 38 is turned clockwise against an urging force of the urging member 39 as a supporting point of an axial portion 38*a*, and with the turning thereof, the responding body 38 receives a lower end corresponding portion of the sliding body 33, so that an upward movement which is a latch release direction of the sliding body 33 (engagement body 36) can be halted. However, FIGS. 8(*a*) to 8(*c*) are illustrated by assuming the case that such safety function could not be exerted due to a lack of stress of the inertial force and the like even if the latch device received the inertial force. Although the safety device of the present invention is used together with a push-push type latch device, this has significance in that the safety device of the present invention is shown as an example in which any structure can be used as the latch device.

Figure 4A:
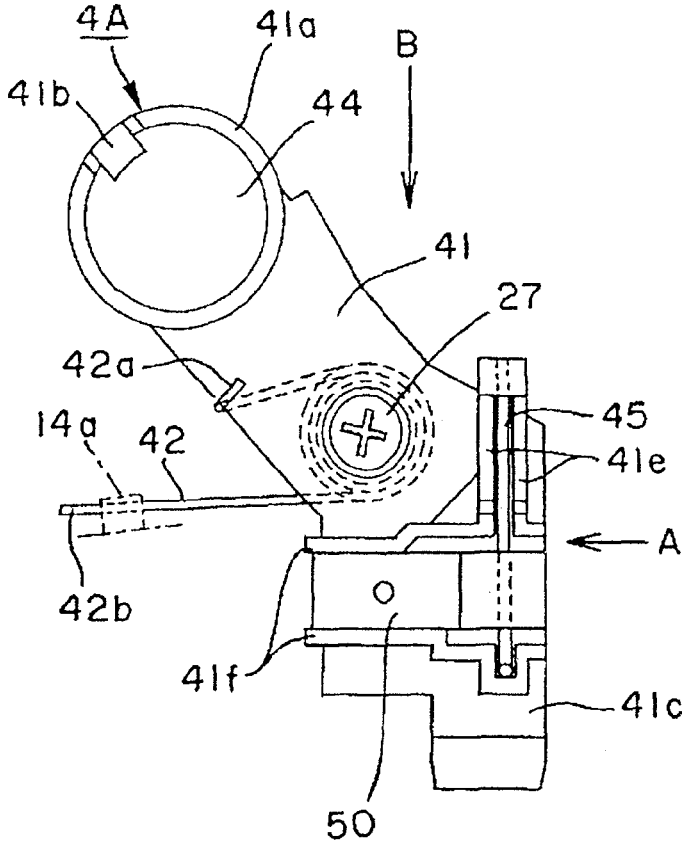
FIG. 4(*a*) is a top view of the above-mentioned safety device, FIG. 4(*b*) is a drawing viewed from an A direction of FIG. 4(*a*), and FIG. 4(*c*) is a drawing viewed from a B direction of FIG. 4(*a*).
Figure 4B:
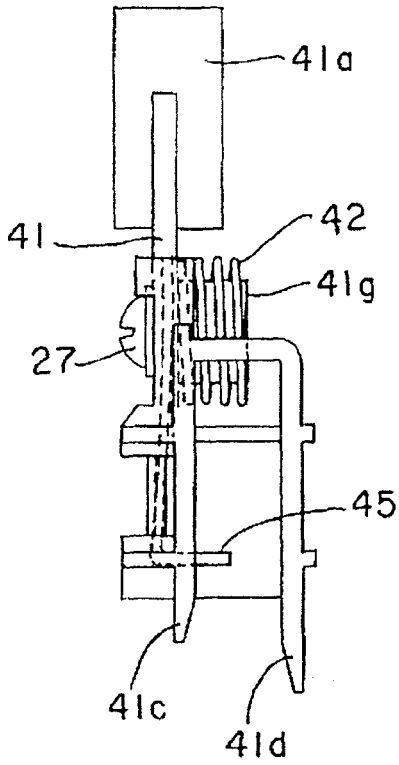
Figure 4C:
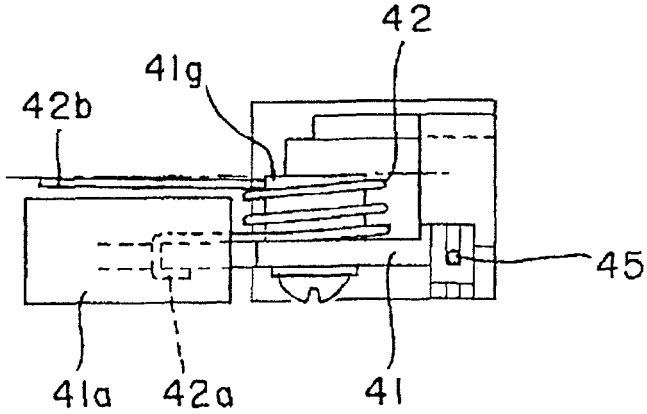
Figure 5:
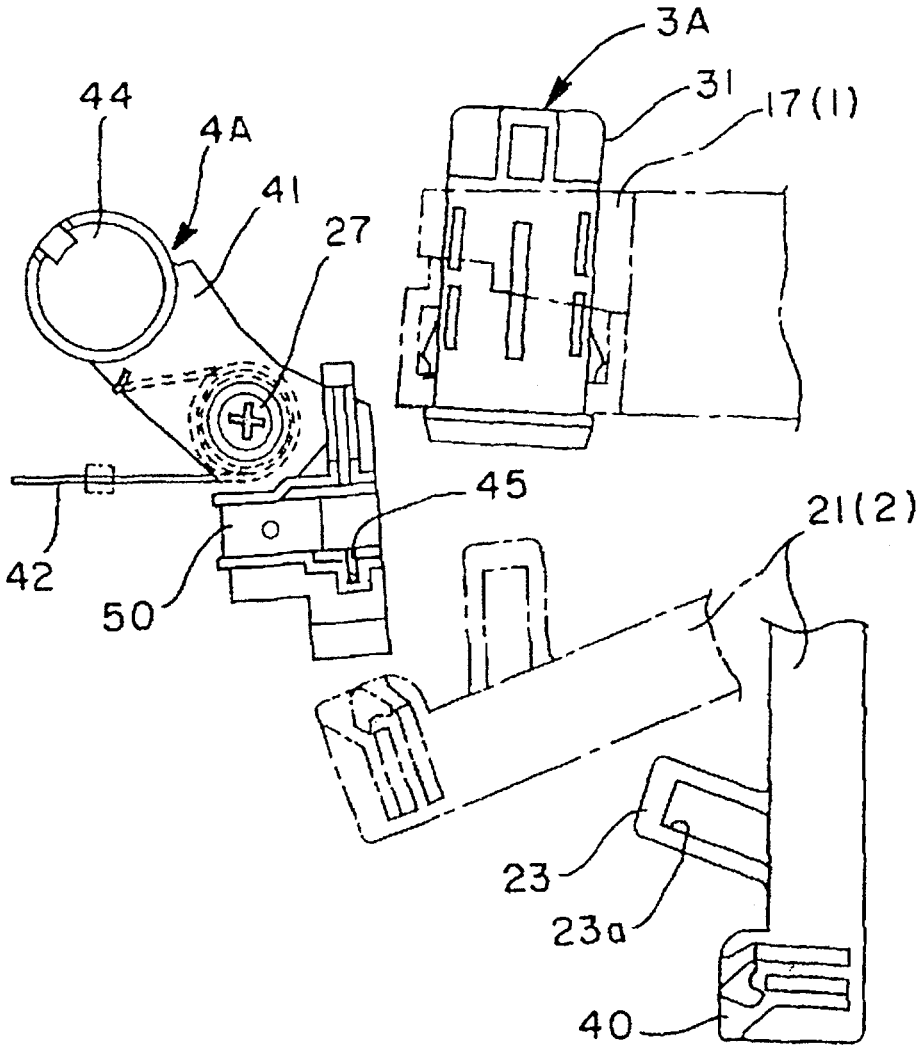
FIG. 5 is a structural view showing a relationship between the safety device and a latch device in the above-mentioned lid open position.
Figure 6:
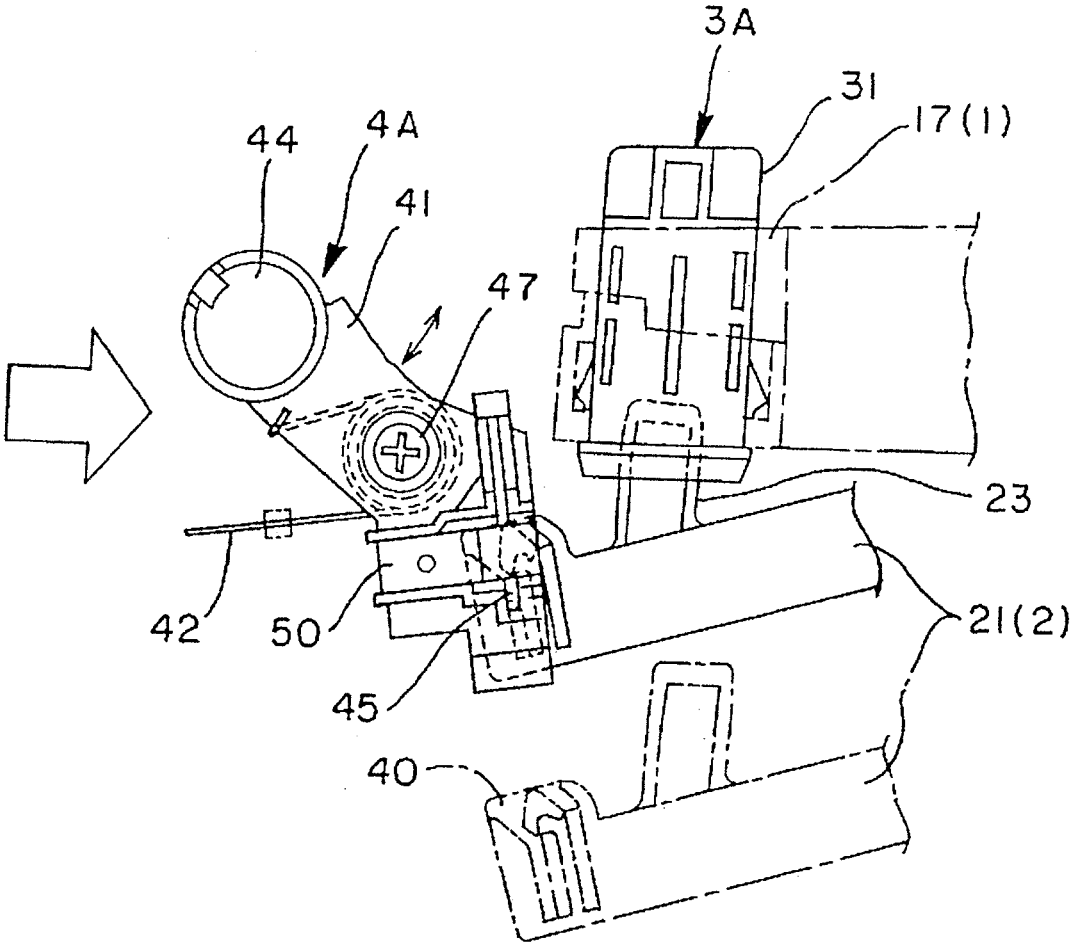
FIG. 6 is a structural view showing the relationship between the safety device and the latch device in the above-mentioned lid closed position.

(Safety device) As shown in FIGS. 4(*a*) to 4(*c*), this safety device 4A comprises a resin responding member 41; an urging member 42 urging the responding member 41; a tracing pin 45 with an approximately L shape and a balancer 44 which is a metallic coin-shaped weight, which are attached to the responding member 41; and an approximately C-shaped leaf spring 50 which is pressing the pin 45. Even if the latching of the latch device 3A (can be the latch device 3 in FIGS. 1(*a*) to 1(*d*)) is released due to the inertial force by the relationship between the pin 45 and the circulation cam groove 40 provided in a lid side arm portion 21, the safety device 4A can retain the lid 2 in the closed position.

Here, the responding member 41 forms a placement portion for the balancer on one end side sandwiching an axis portion of the approximately center portion, and forms a placement portion for the pin and the leaf spring on the other end side. The placement portion for the balancer disposes the balancer 44 inside a circular rib 41*a*, and is retained by an elastic latch claw 41*b* provided in one part of the rib 41*a*. As in FIG. 4(*b*), the placement portion for the pin and the leaf spring is partitioned and forms a C-shaped portion in cross-section by an upper portion 41*c* having approximately the same flat surface as that of the above-mentioned placement portion for the balancer, and a lower portion 41*d* projecting by maintaining a gap with the upper portion 41*c*. The upper portion 41*c* includes a pair of ribs 41*e* provided in a longitudinal direction, a pair of ribs 41*f* provided in a width direction, and a through-hole (not shown in the figures) for the pin provided inside the ribs 41*f* and on an extended line of the ribs 41*e*. In a state wherein the pin 45 is disposed between both ribs 41*e*, the pin 45 projects the short side of the L shape from the above-mentioned through-hole to the above-mentioned C-shaped portion. This pin 45 is pressed in a pin projecting direction by the leaf spring 50 disposed between both ribs 41*f* and the like. Also, the axis portion of the responding member 41 is formed by a cylindrical boss portion 41*g* projecting from a lower surface side.

The above responding member 41 is supported relative to the placement portion 14 on the lid side so as to be freely turnable through a screw 27 and the like, and also urged in one direction through the spring member 42. Specifically, the responding member 41 is pivotally supported in the state wherein the screw 27 is latched to the attachment portion provided in the placement portion 14 through the above-mentioned boss portion 41*g*. The spring member 42 includes a wound spring portion, and the wound spring portion is disposed around the boss portion 41*g*. One end 42*a* is latched to a corresponding portion of the responding member 41, and the other end 42*b* is latched to the housing side latch portion 14*a*, so that the spring member 42 urges the responding member 41 in a clockwise direction. Then, in the open position of the lid in FIG. 2, the responding member 41 hits against the housing side control portion 14*c* so that the turning of the responding member 41 is controlled. Also, in the closed position of the lid in FIG. 3, the pin 45 is disposed in a reciprocation groove portion f of the circulation cam groove 40.

Specifically, as shown in FIGS. 7(*b*), 7(*c*), the circulation cam groove 40 is similar to the heart-shaped cam groove 30 on a latch device side in that the circulation cam groove 40 is located on a fore-end side of the lid side arm portion 21 and provided in a circumference portion of a heart-shaped island 40*a*. However, the circulation cam groove 40 includes the reciprocation groove portion f extending in an entering direction of the pin 45; and a latch groove portion h provided on the opposite side of the entering direction of the pin 45 in the heart-shaped island 40*a* and engaging the pin 45; a latching guide groove portion g provided next to the reciprocation groove portion f and whose one end leads to the latch groove portion h; a returning guide groove portion j leading to the latch groove portion h and extending approximately parallel to the latching guide groove portion g; and a return groove portion k continuously provided in the guide groove portion j and extending to the outside of the cam groove. Also, the guide groove portion g is one step deeper than the reciprocation groove portion f so that if the pin 45 is once entered into this groove portion g from the reciprocation groove portion f, the pin 45 cannot return unintentionally. In a similar fashion, the latch groove portion h is one step deeper than the guide groove portion g so that if the pin 45 is once entered into this groove portion h from the guide groove portion g, the pin 45 cannot return unintentionally.

(Operations) Next, operations of the above safety device 4A will be explained including the relationship with the latch device 3A.

(A) FIGS. 7(*a*), 7(*b*), 8(*a*) show the operations at a normal time when the latch device 3A and the safety device 4A do not receive a load such as an impact and the like, i.e., the inertial force. Specifically, when the lid 2 is switched from the open position in FIG. 2 to the closed position in FIG. 3 relative to the housing 1 by a push operation against the urging force of the spring member 25, as shown in FIG. 7(*a*), the pin 35 traces in an arrow direction relative to the cam groove 30, and the latch device 3A is latched to the latch groove portion. Also, by the next push operation, the above-mentioned latching is released, i.e., the pin 35 traces in the arrow direction relative to the cam groove 30 as in FIG. 8(*a*), and the latch device 3A is eventually moved up to an original place. Thereby, the lid 2 is switched to the open position due to the urging force of the spring member 25. In each process, when the pin 35 traces the above-mentioned cam groove 30, as in FIG. 7(*b*), the pin 45 only freely traces the reciprocation groove portion f of the circulation cam groove 40, so that the safety device 4A never functions as a latch operation. These are the same as those in FIG. 1(*b*).

(B) FIG. 8(*a*) shows an operation at an abnormal time when the lid 2 receives the load such as an impact and the like, i.e., the inertial force in the state wherein the lid 2 is latched to the closed position of the housing 1 through the latch device 3A. Specifically, in the latch device 3A, the inertial force acts as in the next push operation, and as in FIG. 8(*a*), the pin 35 escapes from the latch groove portion, and slightly moves in a release direction of an arrow in FIG. 8(*a*). However, a further movement is controlled by the safety device 4A. Specifically, when the safety device 4A receives the inertial force, as shown in FIG. 8(*b*), after the pin 45 falls into the guide groove portion g from the reciprocation groove portion f, the pin 45 irreversibly moves to the latch groove portion h. As a result, the lid 2 is retained in the closed position of the housing 1. These are the same as those of FIG. 1(*b*).

(C) FIG. 8(*c*) shows the operation when the push operation is carried out for the lid 2 from the state of FIG. 8(*b*). By this push operation, in the safety device 4A, the pin 45 traces from the latch groove portion h to the guide groove portion j, and further to the return groove portion k, and further moves away from the circulation cam groove 40. At the same time, in the latch device 3A, in the above-mentioned latch release state, for example, after the pin 35 once moves to a releasing guide groove portion, the pin 35 traces to the return groove portion, and further moves away from the circulation cam groove portion 30. Eventually, it becomes an initial state wherein the lid 2 is switched to the open position in FIGS. 7(*a*) to 7(*c*). These are the same as those in FIG. 1(*c*).

(D) Incidentally, the above safety device 3A is set as follows by the relationship with the opening and closing mechanism in FIGS. 2, 3. Specifically, in FIG. 3, the reference alphabet Z represents a center of gravity of the lid 2, a line S is a line connecting the rotational center (screw 24) of the lid 2 and the center of gravity Z of the lid.

(D)-1. In this basic setting, in the closed position of the lid 2, by an input force (inertial force) of the impact whose right angle relative to the line S is the minimum, the maximum rotational moment in the open direction is applied to the lid 2. Also, since the line S is set in parallel to the safety device side responding member 41, the rotational moment maximum direction of a lid rotational mechanism and a rotational mechanism of the safety device side responding member is the same.

(D)-2. Then, in the closed position, the lid 2 does not rotate up to 11.9 G of an impact load (this is due to a reaction force setting of the spring member 25 and the latch device 4A). In contrast, the responding member 41 of the safety device 4A rotates at 8 G or above by the impact load from the same direction. Thereby, the responding member 41 on the safety device side rotates before the lid 2 rotates in the open direction, and the above-mentioned pin 45 is latched to the latch groove portion h from the reciprocation groove portion f, and maintains the lid 2 in the closed position.

(D)-3. In the range of an impact input force, in the case of A in FIG. 3, since the lid 2 rotates in a forcedly pulling direction, the lid 2 cannot be switched to the open direction. In the range of the impact input force, in the case of B in FIG. 3, as an example of an underneath poking (the reference alphabet C) which is applied upwardly from underneath, the impact applied to the lid 2 becomes a component force to a rotational moment by an angle θ in FIG. 3. In a similar fashion, the impact input force to the safety device 4A also becomes a component force to a rotational moment direction; however, since the rotational moment maximum direction of the lid 2 and the safety device side responding member 41 is the same direction, the angle θ of the above-mentioned component force is also the same. Therefore, the relationship (of a rotational initiation of the safety device side responding member 41>the rotational initiation of the lid 2) is the same in the whole range of B in FIG. 3. Thus, the lid 2 cannot be opened even due to the impact input force (inertial force) from any direction of 360 degrees.

Modified Example

As shown in FIGS. 9(*a*) to 9(*c*), this safety device 4B comprises a case-like retaining portion 46; a responding member 47 freely slidably disposed in the retaining portion 46; an urging member 48 urging the responding member 47 in a pull-in direction; the tracing pin 45 with an approximately L shape and a balancer 49 which is a metallic weight, which are attached to the responding member 47; and a leaf spring 51 which is approximately C-shaped and pressing the pin 45. Even if the latching of the latch device 3A (can be the latch device 3 in FIGS. 1(*a*) to 1(*d*)) is released due to the inertial force by the relationship between the pin 45 and the circulation cam groove 40 provided in the lid side arm portion 21, the safety device 4B can retain the lid 2 in the closed position.

Here, for example, the retaining portion 46 is integrally formed with the placement portion 14 on a housing side, and opens at one end face. Also, the retaining portion 46 includes a fitting hole portion 46*a* provided on an upper side face and a through-hole 46*b* provided on a back end face. The responding member 47 includes a front portion 47*a* with a short form whose cross-section is slightly smaller than that of a back portion; an elastic claw portion 47*b* and a placement portion 47*c* where the balancer 49 is placed, which are provided in the back portion; and a guiding axial portion 47*d* projecting backwardly from the end face of the back portion. Also, a through-hole penetrating a corresponding portion of the pin 45 with the approximately L shape, and a rib, which controls the position of a corresponding portion of the leaf spring 51, are provided in the front portion 47*a*.

Then, in the state wherein the balancer 49 is placed in the placement portion 47*c*, and wherein the pin 45 is positioned and disposed in a corresponding portion of the front portion 47*a* and also pressed by the leaf spring 51, the responding member 47 is mounted by the back portion being pushed into the retaining portion 46, by the axial portion 47*d* being projected to the outside from the through-hole 46*b*, and also by the claw portion 47*b* being elastically fitted into the fitting hole portion 46*a*. In that case, one end of a coil spring which is the urging member 48 is latched to a latch portion provided on a rear side end face from the inside of the retaining portion 46, and the other end is latched to a corresponding portion of the responding member 47, so that the coil spring urges to move the responding member 47 to a retaining portion 46 side. The responding member 47 is slid in a projecting direction against an urging force of the urging member 48 from an assembly state thereof. This sliding distance is a size d in FIG. 9(*b*) wherein the claw portion 47*b* can slide the fitting hole portion 46*a*.

In a lid open position in FIGS. 2, 10, if the lid 2 is switched to the closed position by the push operation in the state wherein the above responding member 47 is pulled into the retaining portion 46 through the urging member 48 with the minimum projecting amount, the pin 45 is disposed in the reciprocation groove portion f of the circulation cam groove 40 as in the pin 45 of the above-mentioned embodiment. Then, as for the operation of the above safety device 4B, FIGS. 7(*a*) to 7(*c*) and FIGS. 8(*a*) to 8(*c*) are directly applicable to the explanation of the operation of the above-mentioned safety device 4A (and the safety device 4 in FIGS. 1(*a*) to 1(*d*)).

Figure 12A:
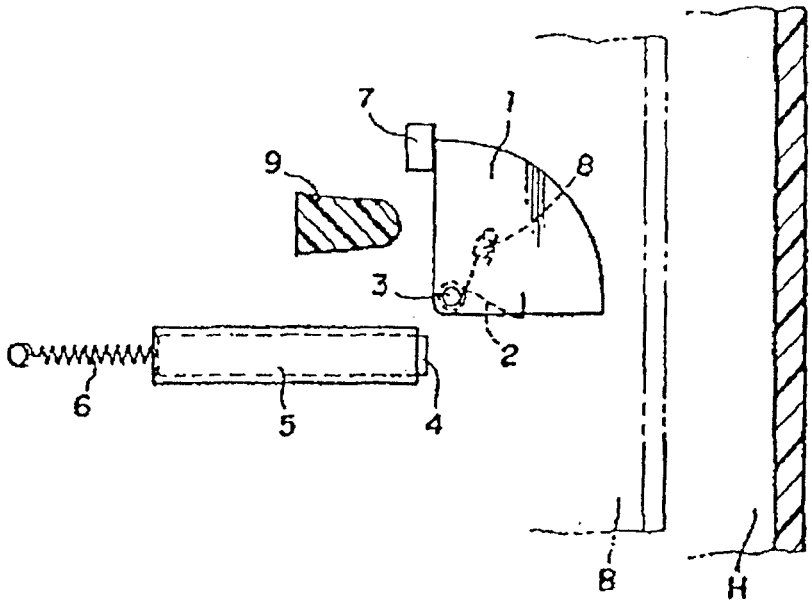
Fig. 12(a) Prior Art
FIGS. 12(*a*), 12(*b*) are explanatory views showing the safety device and the like of Japanese Patent Document 1.
Figure 12B:
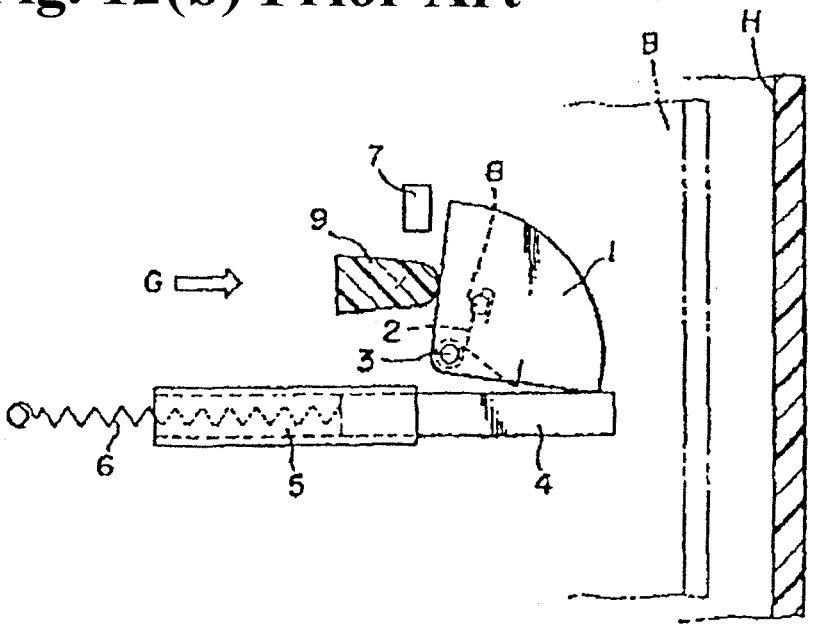
Fig. 12(b) Prior Art

Incidentally, the present invention is never limited to the embodiments or the modified example described hereinabove, and can be variously modified as necessary provided that they comprise requirements specified in the main claim. As one example, as for the opening and closing mechanism of the subject matter of the present invention, for example, in the case that the opening and closing mechanism is applied to the storage device in FIGS. 12(*a*), 12(*b*), an urging means is disposed between a main body (housing) H and a movable body (storage box) B, and also in a rear portion of the main body H, the push-push type latch device and the safety devices 4, 4A, 4B are additionally provided, or in a corresponding portion of the movable body (storage box) B, the bumping portion 23 and the circulation cam groove 40 are additionally provided.

What is claimed is:

1. A safety device used together with a push-push latch device which latches a movable body to a main body at a fixed position of the main body by a push operation against an urging force of urging means and which allows a latching to be released by a next push operation, the safety device comprising:

a circulation cam groove adapted to be provided in either the main body or the movable body and having a reciprocation groove portion, a latching guide groove portion, a returning guide groove portion, a return groove, and a latch groove portion;

a responding member adapted to be provided in the other of the main body or the movable body and having a pin provided at one side thereof to trace the circulation cam groove and a balancer at the other side thereof; and an urging member disposed on the responding member to urge the responding member in a pull-in direction;

wherein when the responding member receives a load, the responding member slides against an urging force of the urging member and the pin irreversibly moves from the reciprocation groove portion to the latch groove portion through the latching guide groove portion, so that even if the latching of the latch device is released due to the load, the movable body is retained in the fixed position.

2. A safety device according to claim 1, further comprising a retaining portion to slidably support the responding member to the main body, wherein the pin is disposed in a projecting end side which projects from the retaining portion.

3. A safety device according to claim 2, further comprising a leaf spring attached to the retaining portion to push the pin in one direction.

4. A safety device according to claim 1, wherein the circulation cam groove is arranged such that when the movable body retained in the fixed position receives the push operation, the circulation cam groove allows the pin to move from the latch groove portion to the reciprocation groove portion through the returning guide groove portion, and thereby releasing the movable body from the fixed portion.

5. An opening and closing mechanism which switches a movable body relative to a main body from an open position to a closed position by a push operation against an urging force, and switches the movable body in an open direction from the closed position due to the urging force, comprising the safety device according to claim 1.

* * * * *

UNITED STATES PATENT AND TRADEMARK OFFICE

CERTIFICATE OF CORRECTION

PATENT NO. : 8,567,829 B2
APPLICATION NO. : 13/646064
DATED : October 29, 2013
INVENTOR(S) : Keisuke Suzuki It is certified that error appears in the above-identified patent and that said Letters Patent is hereby corrected as shown below:

Title Page:
Item 62 should read

--Division of application No. 12/735,265, filed on July 6, 2010, now patented, 8,393,651, which is PCT National Stage of International application number PCT/JP/2008/073613 filed on December 25, 2008.--.

Signed and Sealed this
Seventh Day of January, 2014

Margaret A. Focarino

Margaret A. Focarino
*Commissioner for Patents of the United States Patent and Trademark Office*